US007142171B1

(12) United States Patent
Patel et al.

(10) Patent No.: US 7,142,171 B1
(45) Date of Patent: Nov. 28, 2006

(54) HELIX RADIATING ELEMENTS FOR HIGH POWER APPLICATIONS

(75) Inventors: Kanti N. Patel, Newton, PA (US); R. Mark Clark, Langhorne, PA (US); Dennis Mlynarski, Lumberton, NJ (US); Robert G. Davies, Pennsauken, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/105,373

(22) Filed: Apr. 14, 2005

(51) Int. Cl.
*H01Q 1/36* (2006.01)

(52) U.S. Cl. ..... 343/895; 343/895

(58) Field of Classification Search ..... 343/895
See application file for complete search history.

(56) References Cited

U.S. PATENT DOCUMENTS 2,763,003 A * 9/1956 Harris ..... 343/895
3,623,118 A * 11/1971 Monser et al. ..... 343/883
6,663,969 B1 * 12/2003 Masayuki et al. ..... 428/414
7,038,636 B1 5/2006 Larouche et al.
2003/0060731 A1 * 3/2003 Fleischhacker ..... 600/585

* cited by examiner

*Primary Examiner*—Hoang V. Nguyen
*Assistant Examiner*—Dieu Hien Duong
(74) *Attorney, Agent, or Firm*—McDermott Will & Emery LLP.

(57) ABSTRACT

A helix radiating element is disclosed. The helix radiating element includes a support, a base and a helix wire. The support is made up of a dielectric material including a PEEK (Polyetheretherketone) material. The base is coupled to the support and is made up of boron nitride. The helix wire is configured to be wrapped around the support and bonded to the base. The base is coupled to a ground plane. A boron nitride filled adhesive is used to bond the support to the base and bond the helix wire to the base. The boron nitride filled adhesive is also used to bond the base to the ground plane. Heat generated in the helix wire is transferred to the ground plane via the base.

20 Claims, 6 Drawing Sheets

HELIX RADIATING ELEMENTS FOR HIGH POWER APPLICATIONS

CROSS-REFERENCES TO RELATED APPLICATION(S)

Not Applicable.

STATEMENT AS TO RIGHTS TO INVENTIONS MADE UNDER FEDERALLY SPONSORED RESEARCH OR DEVELOPMENT

Not Applicable.

BACKGROUND OF THE INVENTION

The present invention generally relates to helix radiating elements, and more specifically, to methods and devices for providing helix radiating elements for high power applications.

The power handling capability of a helix radiating element is known to be limited by heating effects in the first several turns of the wire. The limitation is usually in the dielectric that supports the wire. Currently, such limitation does not pose too much of a problem because the operating power levels are relatively low and common dielectrics are deemed to be sufficient for handling such power levels.

As applications become more and more capacity driven, there is a corresponding increase in demand for transmission of high power. Traditional dielectrics may no longer be able to perform within tolerable parameters. Consequently, the power handling capability of radiating elements needs to be improved to accommodate higher operating power levels.

Hence, it would be desirable to provide methods and devices that can be used to implement radiating elements to allow such elements to more effectively handle higher operating power levels.

SUMMARY OF THE INVENTION

The present invention improves the power handling capability of radiating elements. In one embodiment, a helix radiating element is disclosed. The helix radiating element includes a support, a base and a helix wire. The support is made up of a dielectric material including PEEK (Polyetheretherketone), a dielectric with high temperature capability. The base is coupled to the PEEK support and is made up of boron nitride. Boron nitride is a low-loss, high temperature ceramic that is thermally conductive. The helix wire is configured to be wrapped around the PEEK support and bonded to the base. The base is coupled to a ground plane. A boron nitride filled adhesive is used to bond the support to the base and bond the helix wire to the base. The boron nitride filled adhesive has thermal conduction capability. The boron nitride filled adhesive is also used to bond the base to the ground plane. Heat generated in the helix wire is transferred to the ground plane via the base.

Low RF (radio frequency) loss (dissipation) and thermally conductive boron nitride and boron nitride filled silicone adhesive dielectrics are tailor made to provide heat transfer from the helix wire to the ground plane. In order to minimize the mass yet provide adequate support structure for the wire, a composite bonded helix support structure of various dielectrics are used.

In one aspect, a method of assembling a helix radiating element is disclosed. The method includes wrapping a helix wire around a support, the support being made up of a dielectric material including PEEK, bonding one end of the helix wire to a base, the base being coupled to the support and made up of boron nitride, bonding a ground plane to the base, and using a boron nitride filled adhesive to bond the support to the base, bond the helix wire to the base and bond the base to the ground plane, wherein heat generated in the helix wire is transferred to the ground plane via the base.

The present invention may provide a number of advantages and/or benefits. For example, the present invention increases the power handling capability of a helix radiating element and improves the return loss match of the radiating element by use of dielectric matching.

Reference to the remaining portions of the specification, including the drawings and claims, will realize other features and advantages of the present invention. Further features and advantages of the present invention, as well as the structure and operation of various embodiments of the present invention, are described in detail below with respect to accompanying drawings, like reference numbers indicate identical or functionally similar elements.

BRIEF DESCRIPTION OF THE DRAWINGS

Aspects, advantages and novel features of the present invention will become apparent from the following description of the invention presented in conjunction with the accompanying drawings.

DESCRIPTION OF THE SPECIFIC EMBODIMENTS

Figure 1:
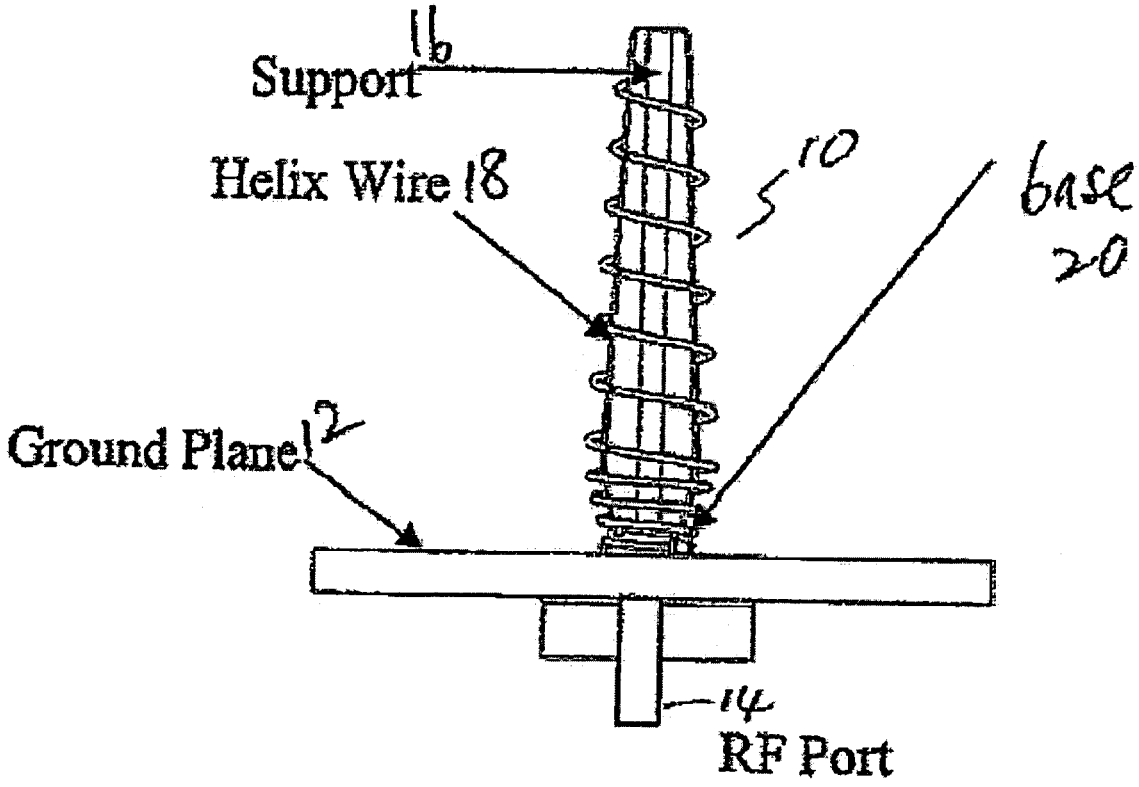
FIG. 1 is a front elevational view of a helix radiating element according to one embodiment of the present invention.
Figure 2:
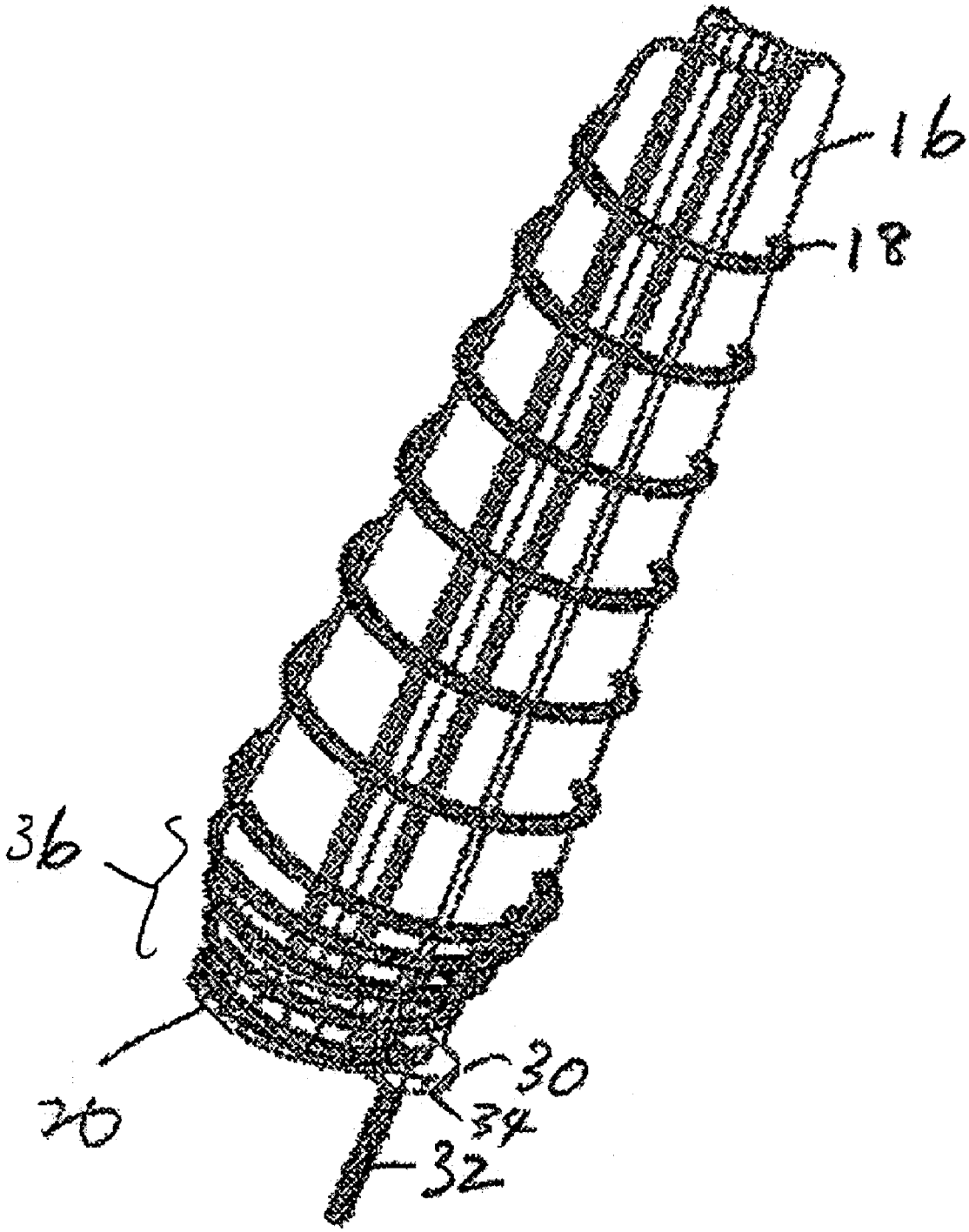
FIG. 2 is a perspective view of the helix radiating element as shown in FIG. 1.

The present invention in the form of one or more exemplary embodiments will now be described. FIG. 1 illustrates one embodiment of a helix radiating element 10 coupled to a ground plane 12. The ground plane 12, in turn, is coupled to a RF (radio frequency) port 14. FIG. 2 further illustrates the helix radiating element 10 as shown in FIG. 1. The helix radiating element 10 includes a support 16, a helix wire 18 and a base 20, each of which will be further described below.

Figure 3:
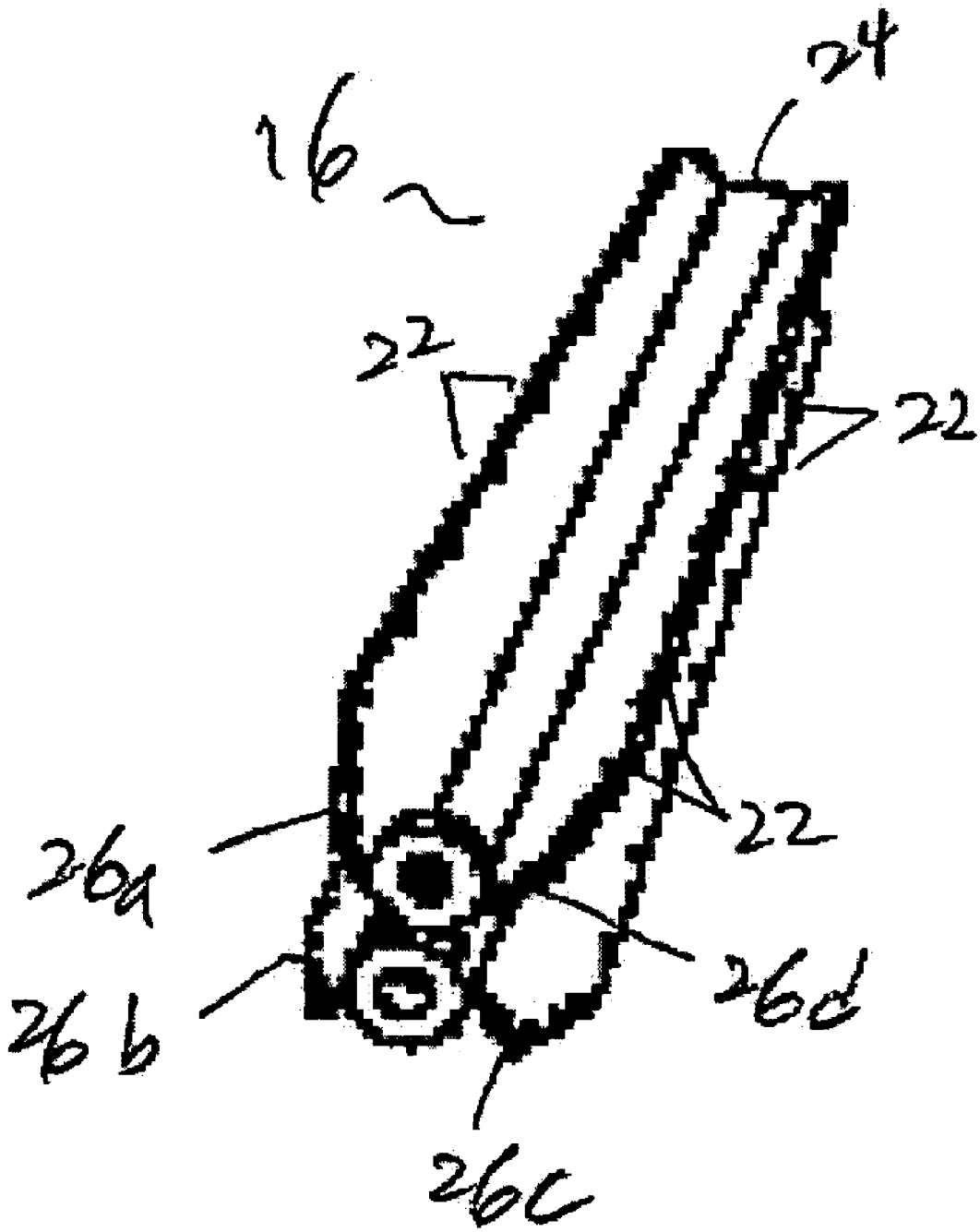
FIG. 3 is a perspective view of a support that is a part of the helix radiating element as shown in FIG. 1.

FIG. 3 illustrates the support 16 in further detail. In one embodiment, the support 16 is machined as one integral piece. The support 16 has a central section 24 and a number of panel sections 26*a–d*. A number of grooves or notches 22 are located along the edge of each of the panel sections 26*a–d*. The grooves 22 are machined at precise locations along the edges to enable the helix wire 18 to be wrapped around the support 16 in a precise geometrical configuration. By positioning the helix wire 18 in a precise geometrical configuration around the support 16, the radiation characteristics of electromagnetic waves emanating from the helix wire 18 can be controlled. Based on the disclosure and teachings provided herein, a person with ordinary skill in the art will appreciate how to position the helix wire 18 in a desired geometrical configuration to effectively control electromagnetic waves radiation characteristics. The support 16 is made up of PEEK dielectric materials that have good structural and thermal properties including, for example, relatively high melting temperature. It should be noted that the support 16 may be made up of other types of dielectric materials having relatively high melting temperature, such as, Nylon and Ultem materials.

Figure 4:
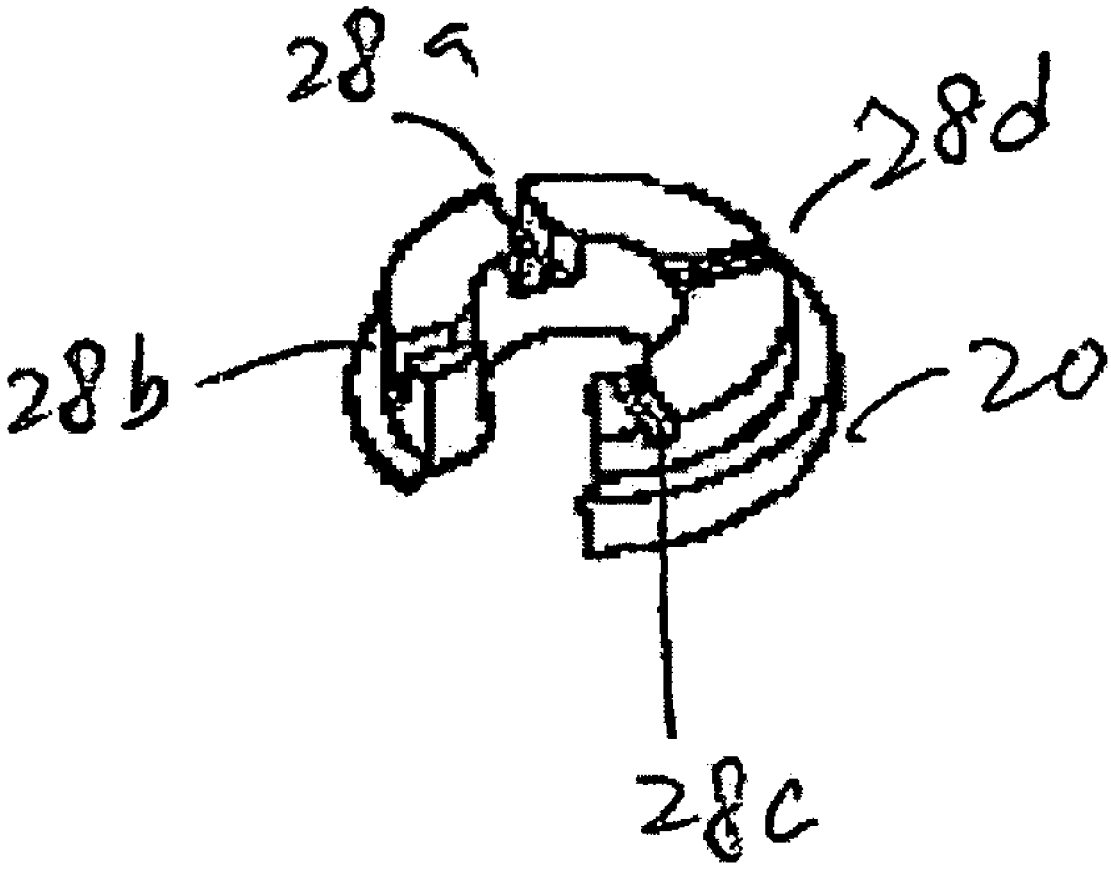
FIG. 4 is a perspective view of a base that is a part of the helix radiating elements as shown in FIG. 1.

FIG. 4 illustrates the base 20 in further detail. The base 20 is machined as one integral piece with grooves or notches 28*a–d*. The composition of the base 20 includes boron nitride. The grooves 28*a–d* are positioned at certain specific locations so as to enable the panel sections 26-*a–d* of the support 16 to fit into and be bonded with the corresponding grooves 28*a–d*. As will be further described below, the support 16 is bonded to the base 20 using a boron nitride filled adhesive.

The helix wire 18 is wrapped around the support 16 and the base 20. In one embodiment, the helix wire 18 is made up of solid aluminum with a diameter of, for example, 0.080". As noted above, the diameter of the helix wire 18 and its geometrical configuration (e.g., the helix diameter and pitch) around the support 16 are chosen such that the electromagnetic wave radiation and the power handling capability of the helix radiating element 10 are optimized. The helix wire 18 is secured into the grooves 22 along the edges of the panel section 26*a–d* to effect the desired geometrical configuration. Based on the disclosure and teachings provided herein, a person with ordinary skill in the art will appreciate how to select the appropriate diameter and geometrical configuration.

Figure 5:
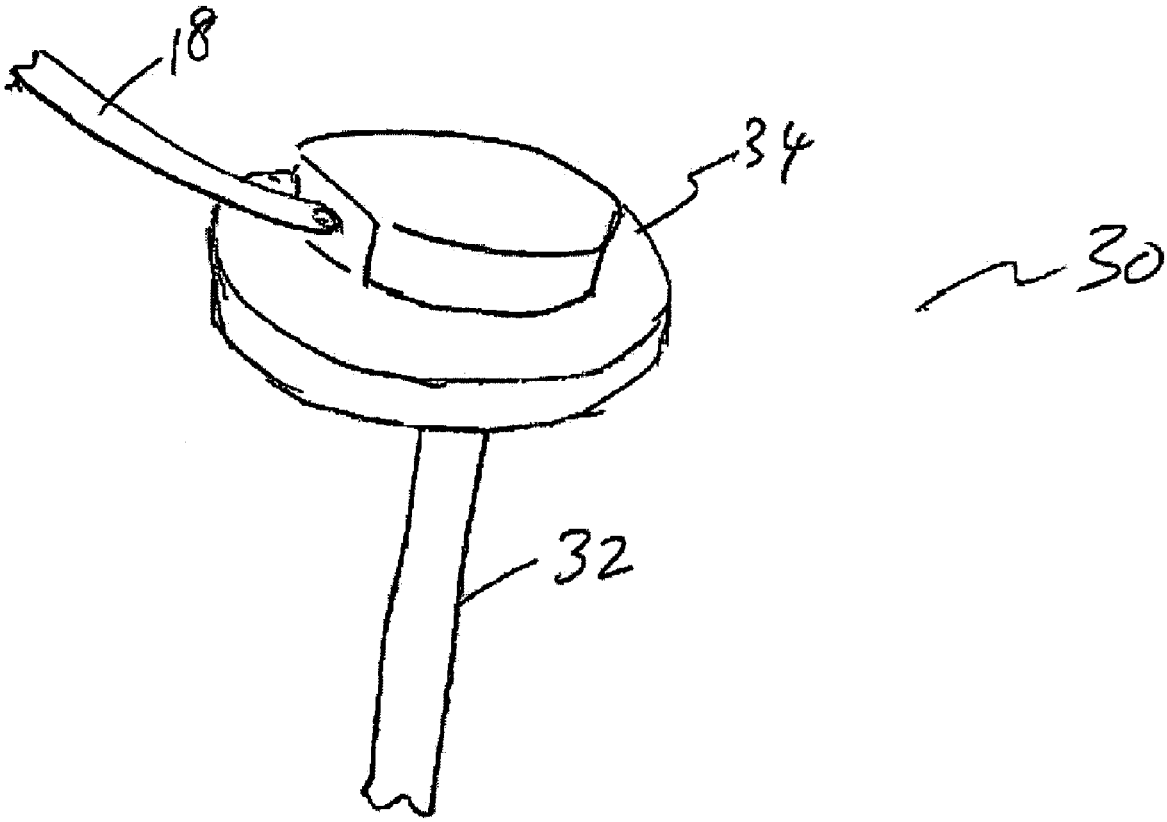
FIG. 5 is a perspective view of a lug that is a part of the helix radiating element as shown in FIG. 2.

The helix wire 18 is made up of two (2) parts. One part is a cylindrical section with a uniform diameter of, for example, 0.080". The second part is a lug 30. The lug 30 is also made of solid aluminum. FIG. 5 further illustrates an embodiment of the lug 30. The lug 30 further includes a wire base 34 and a pin 32. The wire base 34 and the pin 32 are machined as one integral piece. The cylindrical section of the helix wire 18 is welded to the lug 30 at the wire base 34. The pin 32 forms a coaxial line input for RF power. The coaxial line input can be attached to a RF connector or directly integrated with other RF components, such as, a diplexer/filter etc.

To further control heat dissipation, a number of bottom turns 36 (e.g., four (4) turns) of the helix wire 18 from the base 20 are painted with black thermal paint. The black thermal paint provides better thermal emissivity which helps dissipate heat further by radiation.

Figure 6:
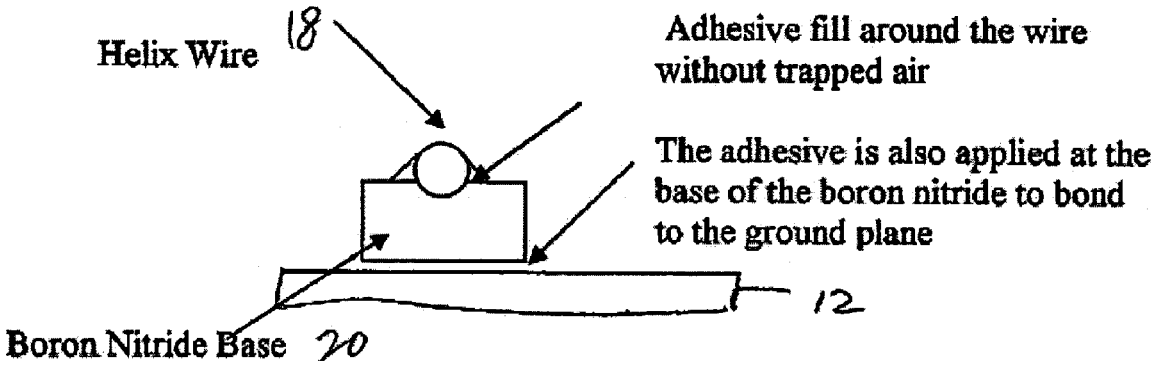
FIG. 6 is a cross-sectional view of how a helix wire is bonded to a base according to one embodiment of the present invention.

FIG. 6 further illustrates how the helix wire 18 is bonded to the base 20. The helix wire 18 is bonded to the base 20 using a boron nitride filled adhesive. The boron nitride filled adhesive includes silicone and boron nitride. The adhesive is used to bond the helix wire 18 along its longitudinal length for the first turn around the base 20. The adhesive is also applied to the bottom of the base 20 to bond the base 20 to the ground plane 12 using, for example, a wet bond joint. Furthermore, the adhesive is used to bond the support 16 to the base 20 and to fill up the space between the helix wire 18 and the base 20 without leaving any trapped air or voids. If air or voids (that are larger than 0.010") exist between the helix wire 18 and the base 20, sufficient voltage may be developed between the helix wire 18 and the base 20 to trigger RF breakdown due to multipaction and/or the Corona effect when high power is transmitted through the helix wire 18 in an outer space environment.

By using the helix element assembly 10, heat transfer or dissipation can be effectively managed in two ways, for example, via the properties of the boron nitride and the thermal paint on the helix wire 18. Due to the thermal conductivity properties of boron nitride, a heat transfer path is provided allowing heat from the helix wire 18 to dissipate via the ground plane 12. More specifically, heat generated in the helix wire 18 is transferred to the base 20 which, in turn, transfers the heat to the ground plane 12. Furthermore, use of boron nitride also permits transmission of high power through the helix wire 18 without burning up materials or multipacting at high power levels.

Boron nitride and the boron nitride filled adhesive experience low loss at RF frequency. Consequently, the use of boron nitride and boron nitride filled adhesive also minimizes RF dielectric losses.

The helix radiating element 10 has been successfully tested for high power handing in TVAC (thermal vacuum) chamber up to power level exceeding 240 watts at S-band. Since RF loss (i.e., dissipation) at lower frequencies is much less, even higher power levels can be achieved at lower frequencies.

Based on the disclosure and teachings provided herein, it should be understood that the present invention can be used in a variety of high power applications including, for example, RF communications circuitry for use in connection with satellites and other space-based applications. A person of ordinary skill in the art will appreciate other ways and/or methods to deploy the present invention in different types of applications.

The above description is illustrative but not restrictive. Many variations of the present invention will become apparent to those skilled in the art upon review of the disclosure. The scope of the present invention should, therefore, be determined not with reference to the above description, but instead should be determined with reference to the pending claims along with their full scope or equivalents.

What is claimed is:

1. A helix radiating element comprising:

a support, the support being made up of a dielectric material including PEEK (Polyetheretherketone);

a base coupled to the support, the base being made up of boron nitride;

a helix wire configured to be wrapped around the support and bonded to the base; and a ground plane coupled to the base;

wherein a boron nitride filled adhesive is used to bond the support to the base, to bond the helix wire to the base and to bond the base to the ground plane, and wherein heat generated in the helix wire is transferred to the ground plane via the base.

2. The helix radiating element of claim 1 wherein the helix wire is wrapped around the support in a geometrical configuration, the geometrical configuration chosen to optimize electromagnetic wave radiation.

3. The helix radiating element of claim 2 wherein the support further includes a plurality of grooves, the plurality of grooves being used to secure the helix wire to form the geometrical configuration.

4. The helix radiating element of claim 1 wherein the helix wire is made up of aluminum.

5. The helix radiating element of claim 1 wherein the boron nitride filled adhesive includes boron nitride and silicone.

6. The helix radiating element of claim 1 wherein the boron nitride filled adhesive is further used to fill up space between the helix wire and the base without leaving any trapped air therebetween.

7. The helix radiating element of claim 1 wherein the helix wire further includes a first section and a second section;

wherein the first section is bonded to the base;

wherein the second section includes a lug having one end, the first section being welded to the lug, the one end of the lug forming a coaxial line input for RF (radio frequency) power.

8. The helix radiating element of claim 7 wherein the coaxial line input is configured to be coupled to a RF component.

9. A RF communications circuit incorporating the helix radiating element as recited in claim 1.

10. A satellite incorporating the helix radiating element as recited in claim 1.

11. A method of assembling a helix radiating element, the method comprising:

wrapping a helix wire around a support, the support being made up of a dielectric material including PEEK (Polyetheretherketone);

bonding one section of the helix wire to a base, the base being coupled to the support and made up of boron nitride;

bonding a ground plane to the base; and using a boron nitride filled adhesive to bond the helix wire to the base and to bond the base to the ground plane;

wherein heat generated in the helix wire is transferred to the ground plane via the base.

12. The method of claim 11 wherein the helix wire is wrapped around the support in a geometrical configuration, the geometrical configuration chosen to optimize electromagnetic wave radiation.

13. The method of claim 12 wherein the support further includes a plurality of grooves, the plurality of grooves being used to secure the helix wire to form the geometrical configuration.

14. The method of claim 11 wherein the helix wire is made up of aluminum.

15. The method of claim 11 wherein the boron nitride filled adhesive include boron nitride and silicone.

16. The method of claim 11 further comprising:

using the boron nitride filled adhesive to fill up space between the helix wire and the base without leaving any trapped air therebetween.

17. The method of claim 11 wherein the helix wire further includes a first section and a second section having a lug with one end, the method further comprising:

bonding the first section to the base; and welding the first section to the lug, the one end of the lug forming a coaxial line input for RF (radio frequency) power.

18. The method of claim 17 wherein the coaxial line input is configured to be coupled to a RF component.

19. A RF communications circuit incorporating the helix radiating element assembled according to the method as recited in claim 11.

20. A satellite incorporating the helix radiating element assembled according to the method as recited in claim 11.

* * * * *